US007398979B2

(12) United States Patent
Yu Chen

(10) Patent No.: US 7,398,979 B2
(45) Date of Patent: Jul. 15, 2008

(54) REEL STAND

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 112 days.

(21) Appl. No.: 11/590,915

(22) Filed: Nov. 1, 2006

(65) Prior Publication Data

US 2008/0100013 A1 May 1, 2008

(51) Int. Cl.
*B62B 1/14* (2006.01)

(52) U.S. Cl. ..... 280/47.24; 280/79.4

(58) Field of Classification Search ..... 280/47.24, 280/47.17, 47.19, 47.28, 79.3, 79.4, 47.131; 242/557, 566, 563.2, 571, 563; 83/522.11
See application file for complete search history.

(56) References Cited

U.S. PATENT DOCUMENTS 875,476 A * 12/1907 Wasson ..... 242/557
2,896,877 A * 7/1959 Vaughn ..... 242/557
4,137,939 A * 2/1979 Chow ..... 137/355.27
4,253,716 A * 3/1981 Turner, Jr. ..... 312/100
4,366,933 A * 1/1983 Broussard ..... 242/557
4,457,527 A * 7/1984 Lowery ..... 280/47.19
4,700,737 A * 10/1987 Nelson ..... 137/355.27
4,723,568 A * 2/1988 Adams ..... 137/355.17
5,158,243 A * 10/1992 Sigle et al. ..... 242/557
5,388,609 A * 2/1995 Ghio et al. ..... 137/355.27
5,931,484 A * 8/1999 Jones et al. ..... 280/47.24
D542,124 S * 5/2007 Sellers ..... D8/359

* cited by examiner

*Primary Examiner*—Christopher Ellis
*Assistant Examiner*—Bridget Avery
(74) *Attorney, Agent, or Firm*—Ming Chow; Sinorica, LLC

(57) ABSTRACT

A reel stand has a main frame consisting of a rod, a connecting member and a standing frame. The rod is connected in the connecting member with its lower portion. The standing frame connected with the connecting member has a T-shaped rod and a wheel axle. The T-shaped rod includes a horizontal rod and a longitudinal rod connected vertically with the horizontal rod. The rear portion of the longitudinal rod is bent upwards to form a free end for connecting with the connecting member. The wheel axle is connected with the longitudinal rod on the bent portion of the longitudinal rod to parallel with the horizontal rod, and fitted with a wheel at its two ends respectively. The standing frame carries the band reel to stand on the ground and can be moved around.

5 Claims, 4 Drawing Sheets

REEL STAND

BACKGROUND OF THE INVENTION

1. Field of the Invention

This invention relates to a reel stand, particularly to its main frame.

2. Description of the Prior Art

Commonly, as shown in FIG. 1, a traditional reel stand includes a main frame 10 consisting of a rod 11, a connecting member 12 and a standing frame 13. The rod 11 is bent vertically near its top end to form a handle 111 and connected fixedly in a groove of the connecting member 12 with its bottom end. The bottom end of the connecting member 12 is connected with the standing frame 13 that is provided with a U-reversed vertical longitudinal rod 131 and a U-reversed horizontal rod 132 having its two ends connected with the U-reversed vertical rod 131 respectively near its two ends. The U-reversed horizontal rod is penetrated with an axle 133 through its two ends, so that each end of the axle 133 can be fitted pivotally with a wheel 134, enabling the reel stand to move freely. But, with the standing frame 13 formed of U-reversed vertical rod 131 and the U-reversed horizontal rod 132, the handle 111 is actually unable to push the traditional reel stand so conveniently, especially when making a turn.

SUMMARY OF THE INVENTION

The objective of this invention is to offer a reel stand.

The main characteristic of the invention is a main frame consisting of a rod, a connecting member and a standing frame. The rod installed longitudinally has its upper portion bent to form a handle and is connected in the connecting member with its lower portion. The lower portion of the connecting member is connected with the standing frame that includes a T-shaped rod and a wheel axle. The T-shaped rod positioned horizontally is provided with a horizontal rod and a longitudinal rod connected vertically at the center of the horizontal rod. The rear portion of the longitudinal rod of the T-shaped rod is bent upwards to form a free end for connecting with the connecting member. The wheel axle is connected with the longitudinal rod just under the point aligned with the vertical portion of the longitudinal rod to parallel with the horizontal rod, and fitted with a wheel at its two ends respectively. Therefore, the standing frame can carry the reel to stand on the ground or be moved around. Moreover, the main frame has a small bulk favoring movement of the reel stand. The standing frame and the rod can also be disassembled from the connecting member, keeping the reel stand convenient for storing or delivery, achieving a multi-function economic effect.

BRIEF DESCRIPTION OF DRAWINGS

This invention is better understood by referring to the accompanying drawings, wherein.

DETAILED DESCRIPTION OF THE PREFERRED EMBODIMENT

Figure 1:
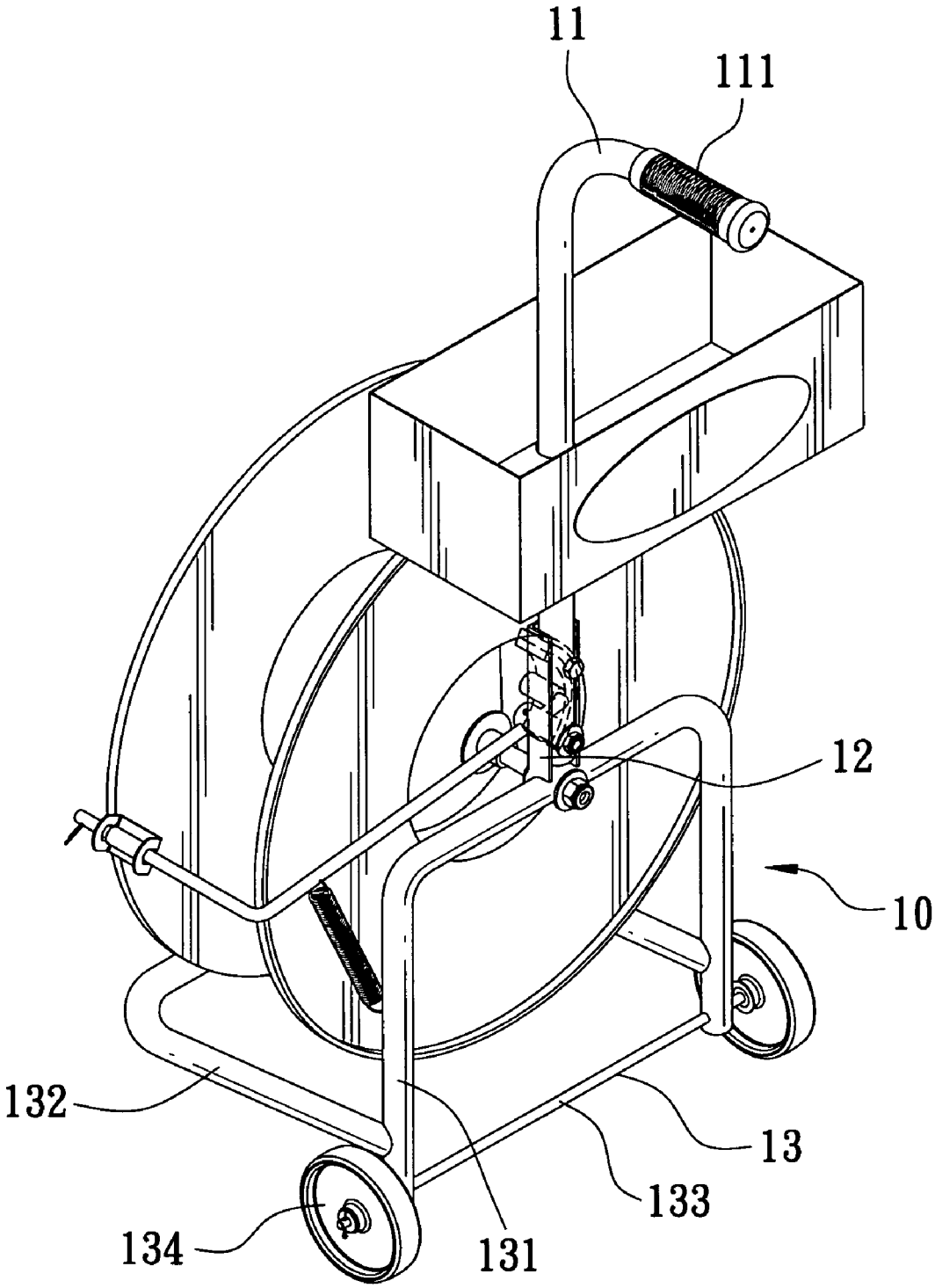
FIG. 1 PRIOR ART
FIG. 1 is a perspective view of a traditional reel stand.
Figure 2:
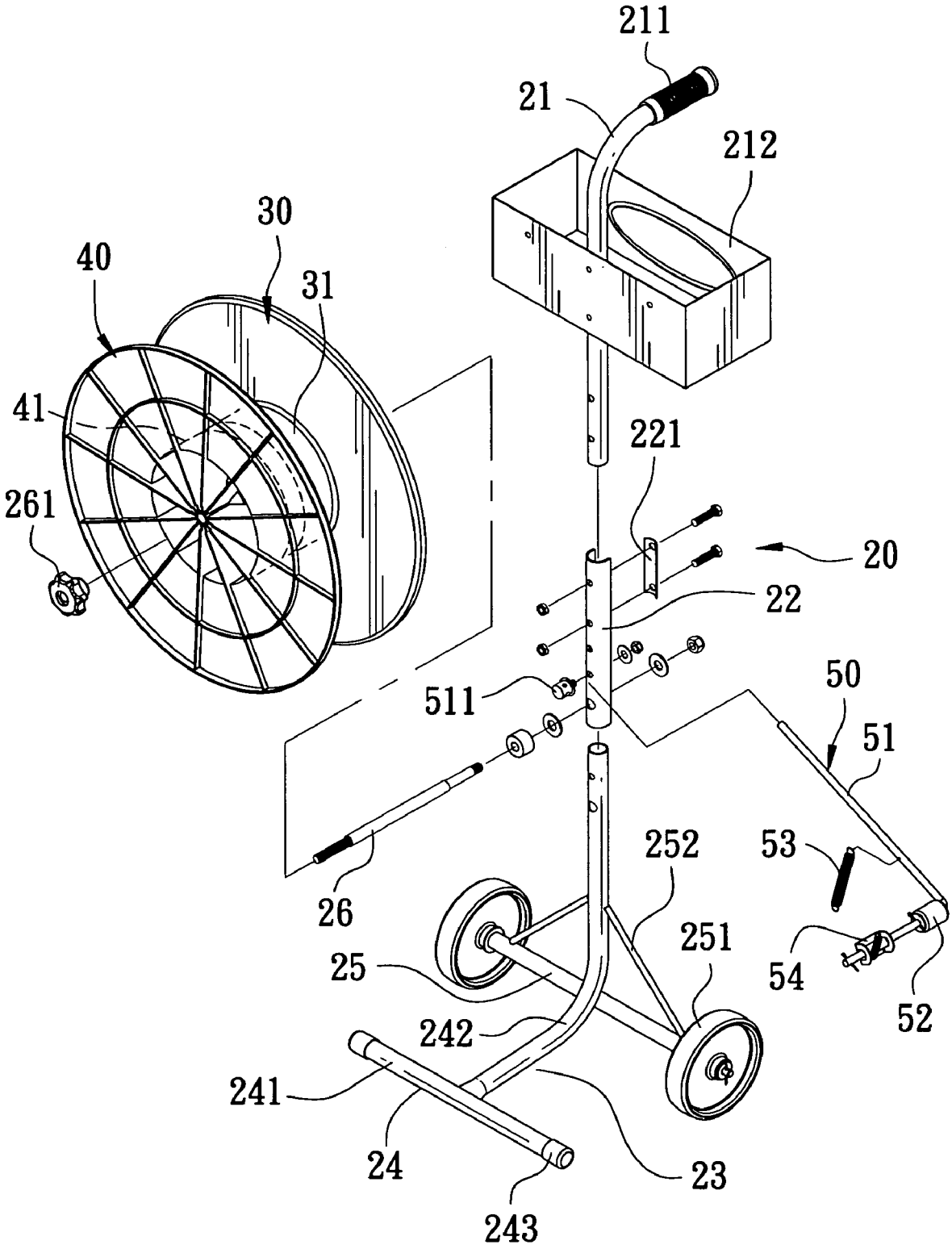
FIG. 2 is an exploded perspective view of a first preferred embodiment of a reel stand in the present invention.
Figure 3:
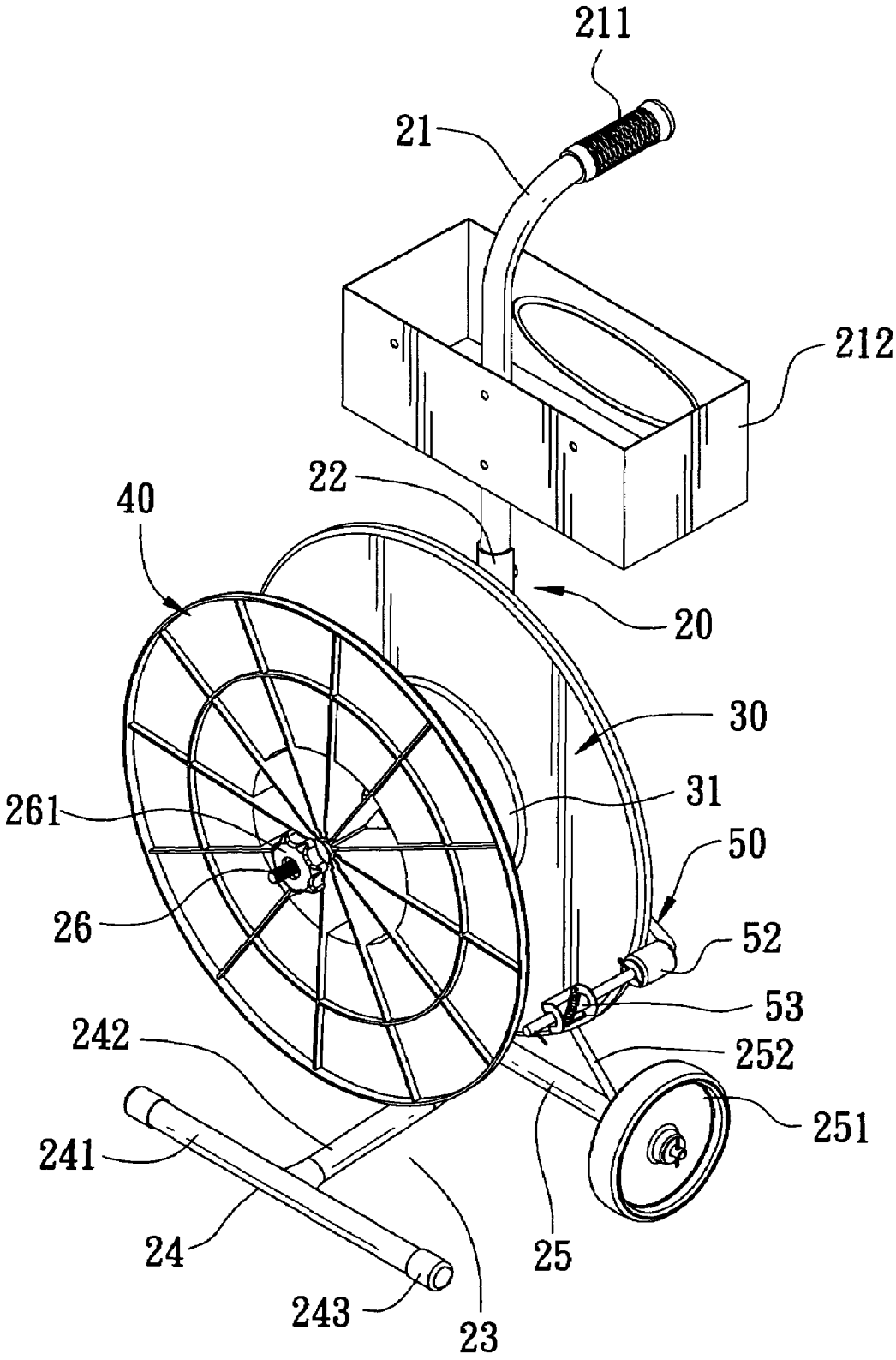
FIG. 3 is a perspective view of the first preferred embodiment of a reel stand in the present invention.

As shown in FIGS. 2 and 3, a preferred embodiment of a reel stand in the present invention consists of a main frame 20, an inner reel disk 30, an outer reel disk 40 and a brake device 50.

The main frame 20 is provided with a rod 21, a connecting member 22 and a standing frame 23. The rod 21 installed longitudinally has its upper portion bent to form a handle 211, penetrating through a basket 212 closely located below the handle 211. The connecting member 22 having a U-shaped horizontal cross-sectional view is connected with the bottom end of the rod 21 in its U-shaped groove. The side of the rod 21 opposite to that fixed in the U-shaped groove of the connecting member 22 is additionally fixed with an arc-like plate 221. The standing frame 23 consists of a T-shaped rod 24 and a wheel axle 25. The T-shaped rod 24 positioned horizontally includes a horizontal rod 241 and a longitudinal rod 242 connected vertically at the center of the horizontal rod 241.

A reel axle 26 is not only to combine the longitudinal rod 242 of the standing frame 23 with the lower portion of the connecting member 22, but also fitted pivotally with the inner reel disk 30 and the outer reel disk 40. The rear portion of the longitudinal rod 242 of the T-shaped rod 24 is bent upwards to form a free end portion for connecting with the connecting member 22.

The wheel axle 25 is connected with the longitudinal rod 242 just under the point aligned with the vertical portion of the longitudinal rod 242 to parallel with the horizontal rod 241. In addition, the wheel axle 25 is fitted with a wheel 251 at its two ends respectively and connected with one end of a supporting rod 252 at the center of its two half sides respectively. The other end of the supporting rod 252 is fixed in the free end portion of the longitudinal rod 242 to keep the supporting rod 252 positioned obliquely, so that the wheel axle 25 and both the supporting rods 252 form a triangle.

The inner reel disk 30 and the outer reel disk 40 are to be fitted with the wheel axle 26 that is fixed in the connecting member 22 of the main frame 20. The inner side of the inner reel disk 30 and that of the outer reel disk 40 facing each other are respectively formed with an annular projecting rim 31, 41 having a diameter smaller than that of the reel disks 31 and 41 for carrying a band reel. In addition, a nut 261 is screwed with the end of the wheel axle 26 outside the outer reel disk 40.

The braking device 50 is composed of an L-shaped rod 51, a braking block 52, an extension spring 53 and a band-guiding clamp 54. The L-shaped rod 51 has a rotating block 511 fitted at its front end, which is connected pivotally with the connecting member 22, so that the L-shaped rod 51 can swing gravitationally. The L-shaped rod 51 is installed along the rear side of the inner reel disk 30 and bent vertically over its edge. The braking block 52 made of rubber and shaped cylindrical is fitted in the elbow of the L-shaped rod 51 to correspond to the edge of the inner reel disk 30 so as to rub against the edge of the inner reel disk 30 for braking while following the L-shaped rod 51 to swing off, making up an external braking device 50. Also, the extension spring 53 is hooked at a preset position of the L-shaped rod 51 before the elbow by its one end, and a preset position of the main frame 20 by the other end, able to restrict the L-shaped rod 51 from swinging up too far owing to its elastic force. The band-guiding clamp 54 is fitted in the rear end of the L-shaped rod 51 for clamping the tail of a packing band.

Figure 4:
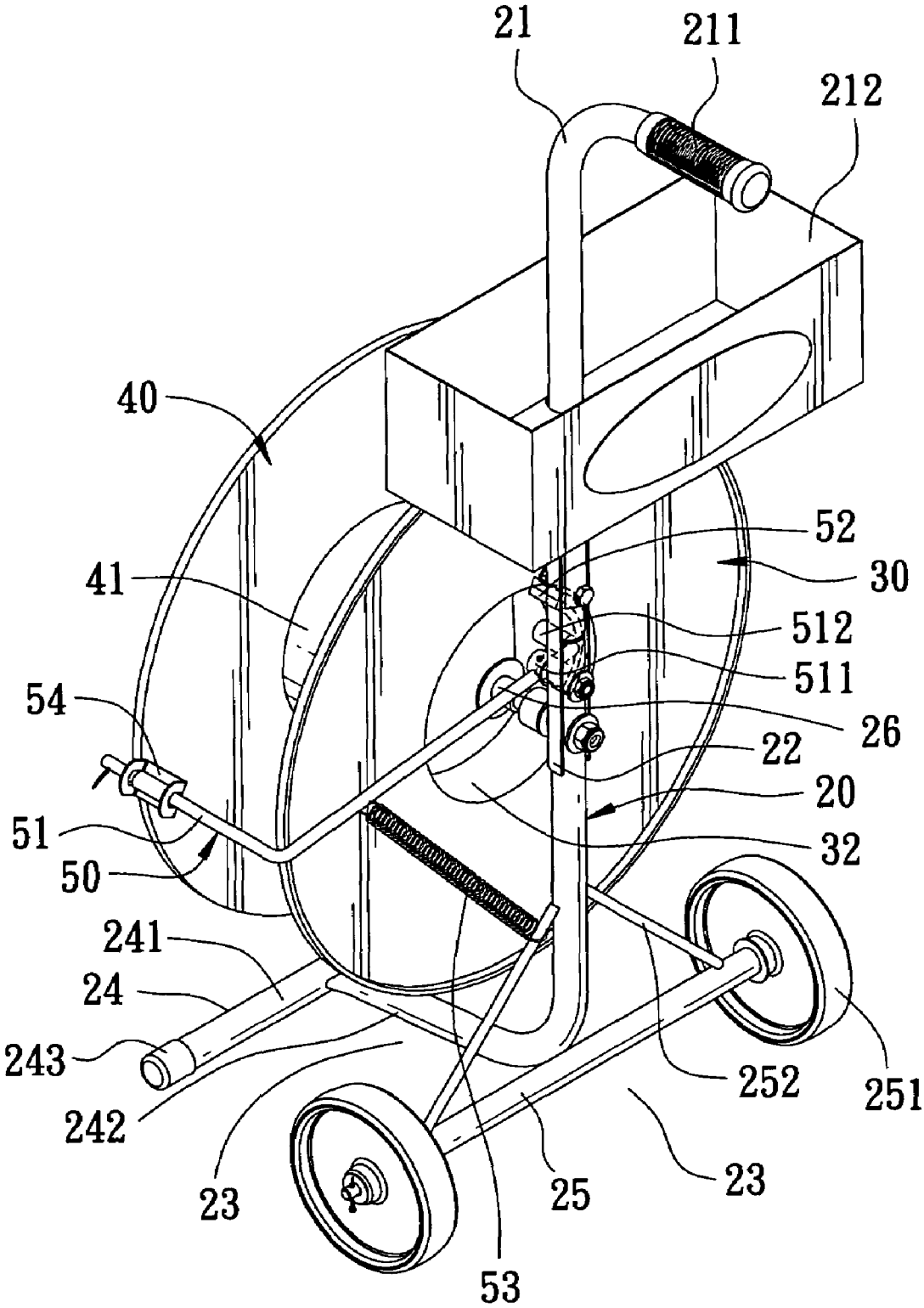
FIG. 4 is a perspective view of a second preferred embodiment of a reel stand in the present invention.

As shown in FIG. 4, a second preferred embodiment of a reel stand in the present invention has a braking device 50 different from that of the first embodiment. There is a round recess 32 concaved around the pivotal connecting point of the inner reel disk 30 and the reel axle 26. The L-shaped rod 51 is provided with a supporting arm 512 extending from its front end, which is fixed in a braking block 521 replacing the braking block 52 in the first embodiment. The braking block 521 formed arc-like is pivotally fixed on the internal wall of the round recess 32 of the inner reel disk 30, acting as an internal braking device 50.

This invention is actually a collapsible reel stand. In assembly, first keep the standing frame 23 fixed in the lower portion of the U-shaped groove of the connecting member 22 by inserting the reel axle 26, which is successively fitted with the inner reel disk 30 and the outer reel disk 40 pivotally. Next, screw the nut 261 with the end of the reel axle 26 and put the rod 21 screwed in the upper portion of the U-shaped groove of the connecting member 22 and screw up the arc-like plate 221 on the opposite side of the rod. Finally, insert the L-shaped rod 51 of the braking device 50 pivotally in the rotating block 511 connected with the connecting member 22 in advance. When the braking device 50 is to be used, hook one end of the extension spring 53 on a preset position of the supporting rod 252 and the other end on a preset position of the L-shaped rod 51, so that the extension spring 53 can restrict elastically the braking device 50 from swinging off. In disassembly, just take a process reverse to that of assembly. First, twist the L-shaped rod 51 of the braking device 50 out of the rotating block 511 and release the extension spring 53 from the main frame 20, disassembling the braking device 50 from the connecting member 22 completely. Next, unscrew the reel axle 26 from the connecting member 22 and unload the reel axle 26 together with the inner reel disk 30 and the outer reel disk 40 simultaneously. Then, the connecting member 22 and the standing frame 23 are separated off. Finally, release the arc-like plate 221 to keep the rod 21 and the connecting member 22 separated. Therefore, all components of the invention are disassembled for packing or storing.

The invention has the following advantages as can be seen from the foresaid description.

1. The T-shaped rod 24 of the standing frame 23 can not only save material to reduce weight, but also stand firmly on the ground for a user to move it conveniently.

2. The main frame 20 is formed via assembling the rod 21, the connecting member 22 and the T-shaped rod 24. And, the connecting member 22 is assembled with the inner reel disk 30, the outer reel disk 40 and the braking device 50. So all the components are able to be disassembled as well, enabling the invention to have a smaller bulk for packing or storing, and saving delivery cost.

3. With the braking block 52 or 521 designed to make up an external or internal braking device 50, the invention can be assembled with various choices.

While the preferred embodiment of the invention has been described above, it will be recognized and understood that various modifications may be made therein and the appended claims are intended to cover all such modifications that may fall within the spirit and scope of the invention.

What is claimed is:

1. A reel stand comprising a main frame, an inner reel disk, an outer reel disk and a brake device, said inner reel disk and said outer reel disk fitted pivotally on said main frame for carrying a reel, said main frame consisting of a rod, a connecting member and a standing frame, said rod having its upper portion bent to form a handle and penetrating through a basket and having its lower portion screwed together with said connecting member that is connected with said standing frame with its lower portion, said braking device including a L-shaped rod fitted with a band-guiding clamp and a braking block; and said standing frame formed of a T-shaped rod and a wheel axle, said T-shaped rod positioned horizontally and provided with a horizontal rod and a longitudinal rod connected vertically at the center of said horizontal rod, an end portion of said longitudinal rod bent upwards to form a free end for connecting with said connecting member, said wheel axle connected with said longitudinal rod just under the point aligned with the vertical portion of the longitudinal rod to parallel with said horizontal rod and fitted with a wheel at its two ends respectively.

2. A reel stand as claimed in claim 1, wherein said wheel axle is connected with one end of a supporting rod at the center of its two half sides respectively, the other end of said supporting rod connected at a preset position in said free end portion of said T-shaped rod to keep said supporting rod positioned obliquely.

3. A reel stand as claimed in claim 1, wherein said connecting member has a U-shaped horizontal cross-sectional view, able to connect said rod in its U-shaped groove, an arc-like plate fixed on a side of said rod opposite to that fixed in said U-shaped groove, said longitudinal rod of said standing frame connected with a lower portion of said connecting member by a reel axle that is also fitted pivotally with said inner reel disk and said outer reel disk.

4. A reel stand as claimed in claim 1, wherein said braking block made of rubber and shaped cylindrical, fitted on an elbow of said L-shaped rod to face to the edge of said inner reel disk.

5. A reel stand as claimed in claim 1, wherein said braking block is formed arc-like, fixed with a supporting arm extending from a front end of said L-shaped rod and pivotally fixed on an internal wall of a round recess concaved in an outer side of said inner reel disk.

* * * * *